US006577049B1

(12) United States Patent
Kim et al.

(10) Patent No.: US 6,577,049 B1
(45) Date of Patent: Jun. 10, 2003

(54) FRAME FOR COLOR CATHODE-RAY TUBE HAVING TWO-STEPPED BEADS FOR IMPROVING IMPACT AND VIBRATION CHARACTER

(75) Inventors: Sung Dae Kim, Daejeon (KR); Sang Hu Park, Suwon (KR)

(73) Assignee: LG Electronics Inc., Seoul (KR)

( * ) Notice: Subject to any disclaimer, the term of this patent is extended or adjusted under 35 U.S.C. 154(b) by 129 days.

(21) Appl. No.: 09/639,117

(22) Filed: Aug. 16, 2000

(30) Foreign Application Priority Data

Aug. 17, 1999 (KR) ..... 1999-33835

(51) Int. Cl.[7] ..... H01J 29/80; H01J 29/07
(52) U.S. Cl. ..... 313/407; 313/408; 313/409
(58) Field of Search ..... 313/407, 402–404, 313/406, 408, 409

(56) References Cited

U.S. PATENT DOCUMENTS 5,103,132 A * 4/1992 Van Der Bolt et al. ..... 313/402
5,698,938 A * 12/1997 Kim et al. ..... 313/402
6,188,170 B1 * 2/2001 Shimizu et al. ..... 313/407
6,215,237 B1 * 4/2001 Tsuchida et al. ..... 313/402

FOREIGN PATENT DOCUMENTS

JP 05121009 A * 5/1993 ..... H01J/29/02
JP 06044919 A * 2/1994 ..... H01J/29/07

* cited by examiner

*Primary Examiner*—Ashok Patel
*Assistant Examiner*—Sikha Roy
(74) *Attorney, Agent, or Firm*—Fleshner & Kim, LLP

(57) ABSTRACT

The present invention relates to a frame for a color CRT having a square framework includes a plurality of beads for strengthening stiffness of the frame formed on the framework including corner portions in order to prevent distortion of the shadow mask. The beads formed on the corner portions are stepped beads having at least two steps. The present invention is capable of strengthening the stiffness of the frames, and increasing an impact character and a vibration character by improving shapes of the beads on the corner portions where stress is concentrated.

11 Claims, 5 Drawing Sheets

FRAME FOR COLOR CATHODE-RAY TUBE HAVING TWO-STEPPED BEADS FOR IMPROVING IMPACT AND VIBRATION CHARACTER

BACKGROUND OF THE INVENTION

1. Field of the Invention

The present invention relates to a frame for a color CRT (Cathode-Ray Tube), in particular to the frame for the color CRT which is capable of increasing an impact character and a vibration character of a shadow mask by strengthening corner portions of the frame.

2. Description of the Prior Art

In general, a frame supporting a shadow mask inside of a color CRT prevents vibrations and distortions of the shadow mask. And, an impact character and a vibration character of the frame can be improved in proportion to stiffness of the frame.

There are many methods for improving the stiffness of the frame, among them increasing thickness of the frame is one of the simple methods.

However, the method is not appropriate because it may cause increase of a unit cost, accordingly product efficiency can be lowered due to that.

Among the methods, a bead forming method is widely used in order to strengthen the stiffness of the frame. In the bead forming method, stiffening beads are formed at a portion imposed stress at the most when vibration displacement or impact displacement occurs.

In the color CRT, particularly corner portions are the portions imposed stress at the most caused by the impact displacement and the vibration displacement.

Hereinafter, the color CRT comprising the conventional frame will now be described with reference to the accompanying drawings.

As depicted in FIG. 1 and FIG. 2, the color CRT comprises a vacuum outer casing including a front panel 1 and a funnel 2 anastomosed on the rear end of the panel 1, a three color fluorescent screen 1*a* having a red R, green G, blue B color, a shadow mask which is supported by a frame 6 and is installed on the rear portion of the panel so as to have a certain distance from the fluorescent screen 1*a* in order to make an electron beam 10 throw electron beams accurately on the fluorescent screen.

And, the frame 6 supports inner upper and lower end of the panel 1 by a spring 4, and an inner shield 11 is combined to the rear end of the frame 6 in order to prevent electron beam 10 from being influenced by an outer magnetic field.

The red, green, blue electron beam 10 radiated by a electron gun 3 is deflected toward the fluorescent screen 1*a* by a vertical horizontal deflection magnetic field of a deflection yoke 8, is subdivided, and can illustrate an image by being thrown on the fluorescent screen 1*a*.

Meanwhile, the electron beam 10 radiated by the electron gun 3 has to be accurately thrown the fluorescent screen 1*a* in accordance with the each color of the screen 1*a*, when the impact and vibration are transferred from outside to the shadow mask 5, the electron beam 10 can not be thrown accurately on the each color of fluorescent screen 1*a*, but is deviated, accordingly wave figures occur on the fluorescent screen 1*a*.

This is called as a microphonic phenomenon, in order to prevent the phenomenon directly, the stiffness of the shadow mask 5 has to increase, or the phenomenon can be prevented indirectly by strengthening the frame 6.

In addition, a drop impact experiment is performed on the color CRT, when there is distortion of the shadow mask as above, the screen 1*a* is uneven, accordingly credibility of the product lowers.

As depicted in FIG. 2 and FIG. 3, In order to prevent above mentioned problems, a plurality of beads 6*a* are protrusively formed at the each inner side and corner of the frame in order to strengthen the stiffness of the frame.

However, as depicted in FIG. 4, most of the stress due to variable vibration modes are concentrated on the corner portions. The each mode shows the vibration distortion in accordance with changes of the frequency.

After all, the beads formed at the each side can not increase the stiffness of the frame.

SUMMARY OF THE INVENTION

It is an object of the present invention to provide a frame for a color CRT which is capable of increasing an impact character and a vibration character of a shadow mask by strengthening corner portions of the frame.

The frame for the color CRT of the present invention having a square framework comprises a plurality of beads for strengthening stiffness of the frame formed on the framework including corner portions in order to prevent distortion of the shadow mask.

Herein, the beads on the corner portions are stepped beads having at least two steps.

In addition, the beads on the corner portions are formed along the width direction of the frame.

In addition, the beads on the corner portions are formed along the circumference direction of the frame.

It is advisable for satisfying equation of $0.1\alpha_1 \leqq \alpha_2 \leqq [\alpha_1-(\delta_1+\delta_2)-R]$ when the overall length of the stepped bead formed on the long side is $\alpha_1$, the length of the lower step of the stepped bead formed on the long side is $\alpha_2$, the overall height of the stepped bead formed on the short side is $\delta_1$, the height of the lower step of the stepped bead formed on the short side is $\delta_2$, and radius is R.

It is advisable for ratio of $\alpha_2$ about $\alpha_1$ to satisfy the range of $0.1<\alpha_2/\alpha_1<0.8$.

It is advisable for ratio of $\beta_2$ about $\beta_1$ to satisfy the range of $0.1<(\beta_2/\beta_1)<0.8$ when the overall length of the stepped bead formed on the short side is $\beta_1$ and the length of the lower step of the stepped bead formed on the short side is $\beta_2$.

It is advisable for ratio of $\gamma_2$ about $\gamma_1$ to satisfy the range of $0.2<(\gamma_2/\gamma_1)<0.8$. when the overall height of the stepped bead formed on the long side is $\gamma_1$ and the height of the lower step of the stepped bead formed on the long side is $\gamma_2$.

It is advisable for ratio of $h_2$ about $h_1$ to satisfy the range of $0.2<(h_2/h_1)<0.65$ when the overall height of the stepped bead formed on the short side is $h_1$ and the height of the lower step of the stepped bead formed on the short side is $h_2$.

DETAILED DESCRIPTION OF THE PREFERRED EMBODIMENT

Hereinafter, the preferred embodiments of the present invention will now be described with reference to the accompanying drawings.

Figure 1:
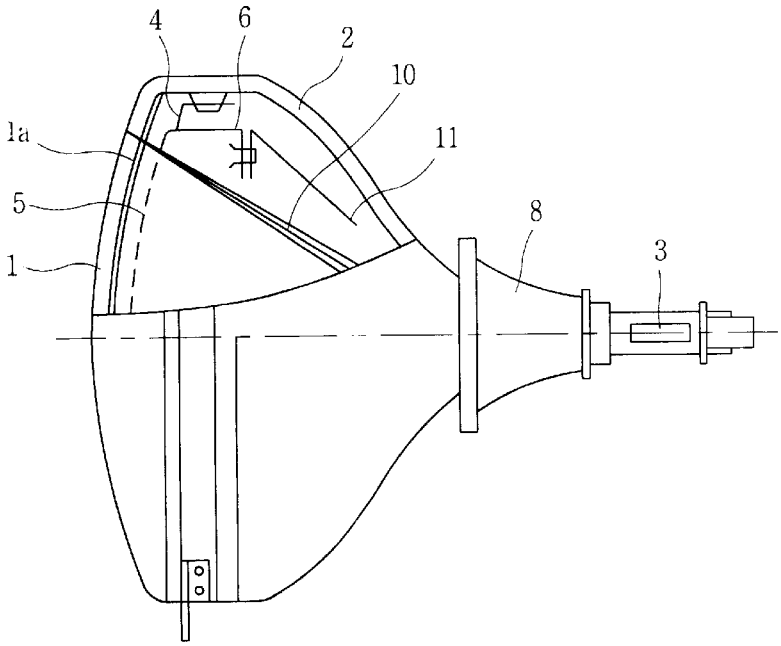
FIG. 1 BACKGROUND ART
FIG. 1 is a vertical cross-sectional view of the general color CRT
Figure 2:
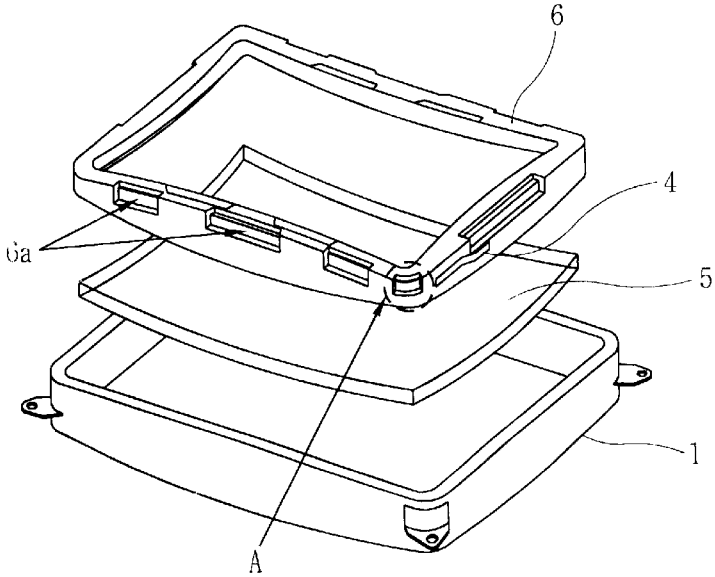
FIG. 2 BACKGROUND ART
FIG. 2 is a perspective view of a panel structure adopting the conventional frame.
Figure 3:
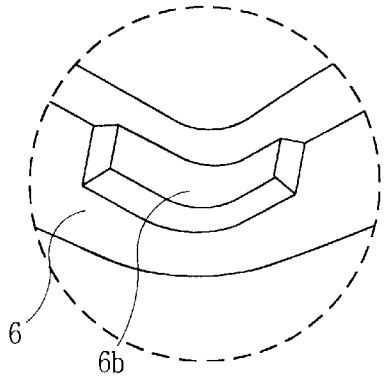
FIG. 3 BACKGROUND ART
FIG. 3 is an enlarged view of the A part of FIG. 2.
Figure 4:
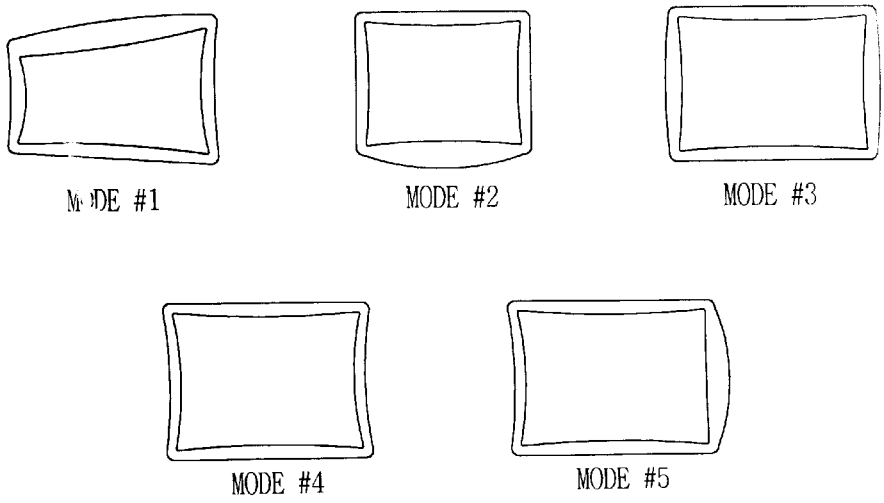
FIG. 4 BACKGROUND ART
FIG. 4 is a state diagram illustrating stress distribution on various vacuum modes.
Figure 5:
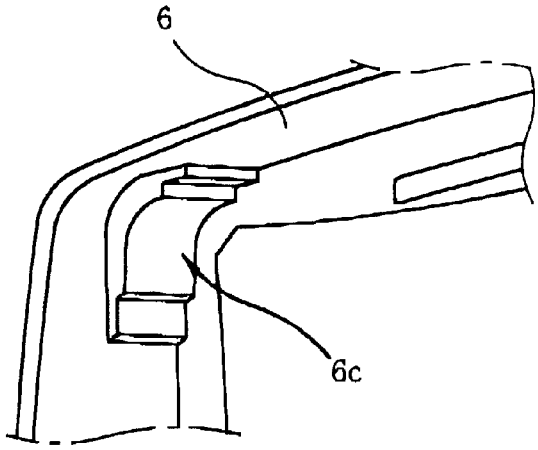
FIG. 5 is an exploded perspective view illustrating a bead formed on frame corner portion of the preferred embodiment of the present invention.
Figure 6A:
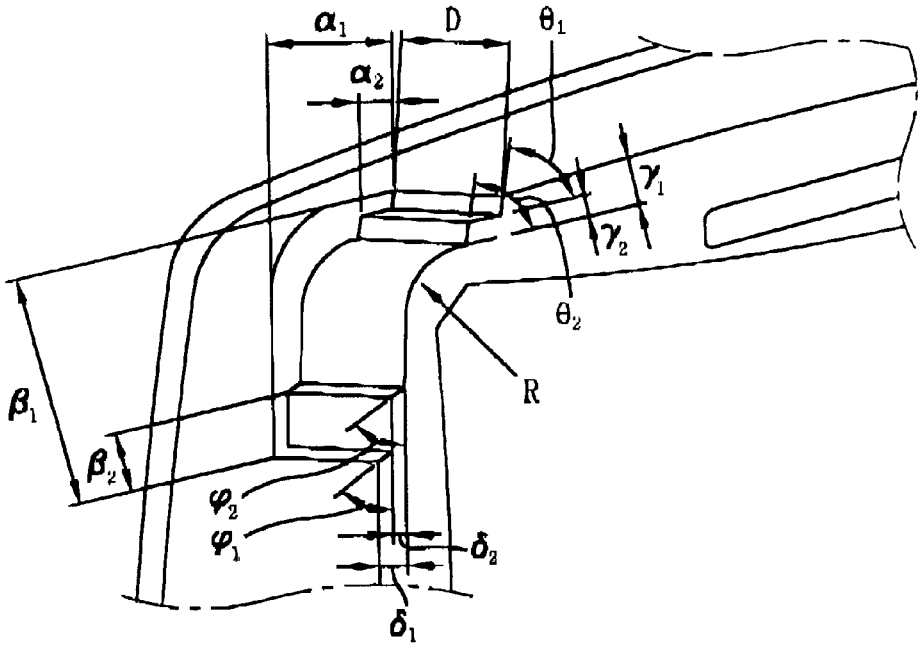
FIGS. 6A and 6B are perspective views illustrating parameter of each part on the frame of the present invention.
Figure 6B:
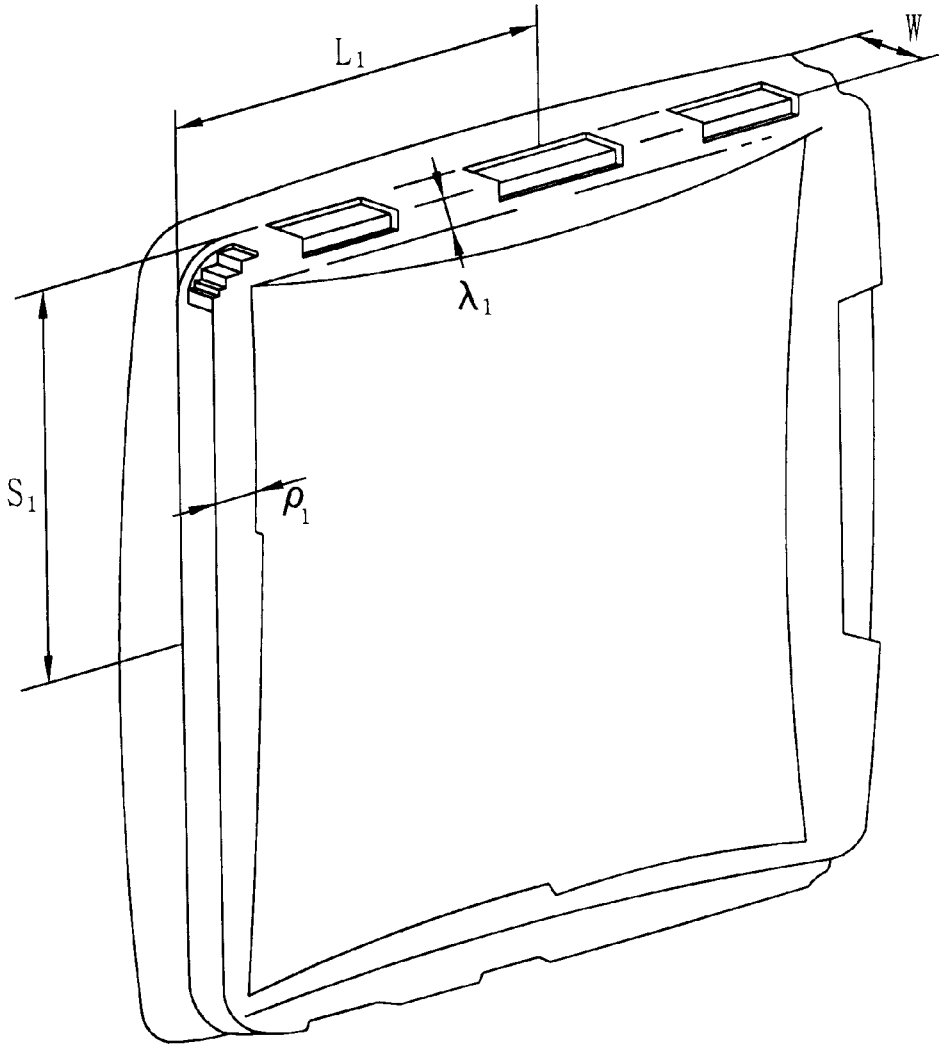
Figure 7:
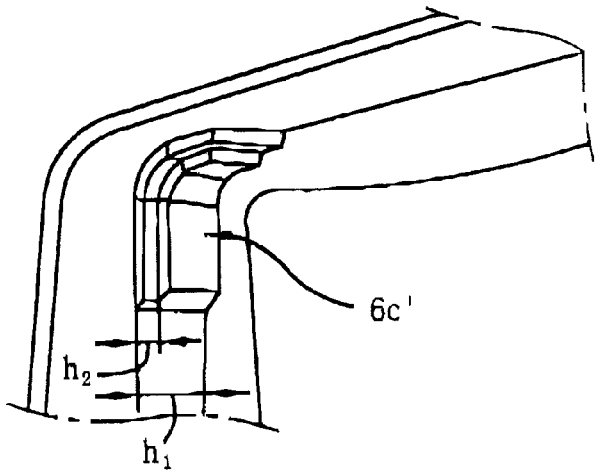
FIG. 7 is a perspective view illustrating bead shape of the other embodiment of the present invention.
Figure 8:
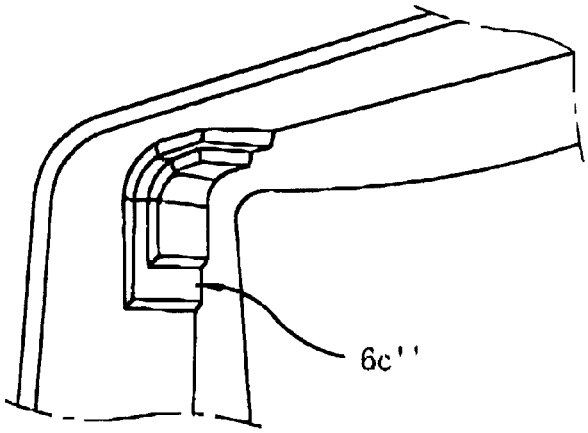
FIG. 8 is a perspective view illustrating bead shape of the another embodiment of the present invention.

FIG. 5 is an exploded perspective view illustrating a bead formed on a frame corner portion of the preferred embodiment of the present invention, FIGS. 6A and 6B are perspective views illustrating parameter of the each part on the frame of the present invention, FIG. 7 is a perspective view illustrating a bead shape of the other embodiment of the present invention, and FIG. 8 is a perspective view illustrating a bead shape of the another embodiment of the present invention.

As depicted in FIG. 5, the frame 6 of the preferred embodiment of the present invention comprises stepped beads 6*c* having two steps along the circumference (framework direction) on the each corner, and numeric of the each part of the stepped beads 6*c* according to size of a CRT is limited as below. (cf. FIG. 6*a*, FIG. 6*b*)

overall length of the stepped bead formed on the long side ($\alpha_1$): $0<\alpha_1<L_1$ length of the lower step of the stepped bead formed on the long side ($\alpha_2$): $0<\alpha_2<\alpha_1-\delta_1$ overall length of the stepped bead formed on the short side ($\beta_1$): $0<\beta_1<S_1$ length of the lower step of the stepped bead formed on the short side ($\beta_2$): $0<\beta_2<\beta_1-\gamma_1$ overall height of the stepped bead formed on the long side ($\gamma_1$): $0<\gamma_1<\lambda_1$ height of the lower step of the stepped bead formed on the long side ($\gamma_2$): $0<\gamma_2<\gamma_1$ overall height of the stepped bead formed on the short side ($\delta_1$): $0<\delta_1<\rho_1$ height of the lower step of the stepped bead formed on the short side ($\delta_2$): $0<\delta_2<\delta_1$ slope angle of the higher step of the stepped bead formed on the long side ($\theta_1$): $0<\theta_1<180°$ slope angle of the lower step of the stepped bead formed on the long side ($\theta_2$): $0<\theta_2<180°$ slope angle of the higher step of the stepped bead formed on the short side ($\psi_1$): $0<\psi_1<180°$ slope angle of the lower step of the stepped bead formed on the short side ($\psi_2$): $0<\psi_2<180°$ (Herein, L1 is ½ of the overall length of the long side, S1 is ½of the overall length of the short side, W is minimum value of the overall width, $\lambda_1$ is minimum value of the width of the long side near the corner portion, and $\rho_1$ is minimum value of the width of the short side near the corner portion.)

It is advisable for satisfying equation of $\alpha_1 \leqq \alpha_2 \leqq [\alpha_1-(\delta_1+\delta_2)-R]$ when the overall length of the stepped bead formed on the long side is $\alpha_1$, the length of the lower step of the stepped bead formed on the long side is $\alpha_2$, the overall height of the stepped bead formed on the short side is $\delta_1$, the height of the lower step of the stepped bead formed on the short side is $\delta_2$, and radius of R.

When the $\alpha_2$ is less than 0.1 cm, it is similar to the conventional bead shape having large width and its efficiency lowers due to limitation of radius R.

And, the overall length of the stepped bead formed on the long side is $\alpha_1$, the length of the lower step of the stepped bead on the long side is $\alpha_2$, it is advisable for satisfying range of $0.1<\alpha_2/\alpha_1<0.8$.

Herein, when $\alpha_2/\alpha_1$ ratio is lower than 0.1, effect of strengthening the stiffness of the frame lowers because there is little difference between the stepped bead and an ordinary bead, when the $\alpha_2/\alpha_1$ ratio is higher than 0.8, frame forming is impossible.

It is advisable for ratio of $\beta_2$ about $\beta_1$ to satisfy the range of $0.1<(\beta_2/\beta_1)<0.8$ when the overall length of the stepped bead formed on the short side is $\beta_1$ and the length of the lower step of the stepped bead formed on the short side is $\beta_2$.

When the ratio of $\beta_2$ about $\beta_1$ is less than 0.1, it is similar to the conventional bead shape having large width and its efficiency lowers, when the ratio of $\beta_2$ about $\beta_1$ is more than 0.8, it is difficult to achieve the object of the present invention due to limitation of radius R as forming condition In addition, the overall height of the stepped bead formed on the long side is $\gamma_1$, the height of the. lower step of the stepped bead on the long side is $\gamma_2$, it is advisable for satisfying range of $0.2<(\gamma_2/\gamma_1<0.7$.

Herein, when $\gamma_2/\gamma_1$ ratio is lower than 0.2, frame forming is impossible, when the $\gamma_2/\gamma_1$ ratio is higher than 0.7, effect of strengthening the stiffness of the frame lowers because there is little difference between the stepped bead and an ordinary bead.

It is advisable for ratio of $h_2$ about $h_1$ to satisfy the range of $0.2<(h_2/h_1)<0.65$ when the overall width of the stepped bead formed on the short side is $h_1$ and the width of the lower step of the stepped bead formed on the short side is $h_2$.

When the ratio of $h_2$ about $h_1$ is less than 0.2, it is impossible to form, when the ratio of $h_2$ about $h_1$ is more than 0.65, it is similar to the conventional bead, accordingly its efficiency for improving the stiffness of the frame lowers.

The stepped bead having two steps 6C formed within the limited numeric can increase the stiffness of the frame on the corner portions better than the bead having one step.

The other preferred embodiment of the present invention will now be described.

As depicted in FIG. 7, a stepped bead 6*c′* having two steps along the width direction of the framework can be formed.

And, another embodiment of the present invention combines the above described two embodiments.

In other words, a stepped bead 6*c″* having two steps along the both the framework direction and width direction in order to prevent stress from concentrating on the both directions, accordingly effect of the strengthening stiffness of the frame can be maximized.

Meanwhile, there is the conventional structure to increase the stiffness of the frame by adding beads, but the effect is much lower than the plurality of steps beads structure of the present invention

TABLE 1

| Natural Frequency | 1st | 2nd | 3rd | 4th | 5th |
|---|---|---|---|---|---|
| Frame without beads | 69.8 | 244.3 | 289.7 | 370.2 | 391.8 |
| Frame with corner bead having one step | 71.9 | 256.8 | 295.6 | 408.0 | 430.6 |
| Frame with stepped corner bead having a plurality of steps | 73.5 | 268.2 | 300.6 | 418.9 | 441.7 |

*unit: Hz

As depicted in table 1, the present invention can increase the impact character and vibration character by improving the frame strengthening structure.

As described above, the present invention is capable of strengthening the stiffness of the frame and increasing the impact character and the vibration character by improving shapes of the beads on the corner portion where stress is concentrated.

What is claimed is:

1. A frame for a color CRT, comprising:

a frame having a square shape configured to support a shadow mask; and a plurality of stepped beads having at least two steps formed on corner portions of the frame in order to prevent distortion of the shadow mask, wherein the stepped beads satisfy the equation of $0.1\alpha_1 \leqq \alpha_2 \leqq$ when the overall length of the stepped bead formed on a long side of the frame is $\alpha_1$, the length of the lower step of the stepped bead formed on the long side is $\alpha_2$, the overall height of the stepped bead formed on a short side of the frame is $\delta_1$, the height of the lower step of the stepped bead formed on the short side is $\delta_2$, and a radius of curvature of the corner portions of the frame is R.

2. The frame for a color CRT according to claim 1, wherein the stepped beads on the corner portions extend along the circumference of the frame.

3. The frame for a color CRT according to claim 1, wherein the stepped beads on the corner portions extend along a width direction of the frame.

4. The frame for a color CRT according to claim 1, wherein the ratio of $\alpha_2$ about $\alpha_1$ is characterized by a range of approximately $0.1<\alpha_2/\alpha_1<$ approximately 0.8.

5. The frame for a color CRT according to claim 1, wherein a ratio of $\beta_2$ about $\beta_1$ is characterized by a range of approximately $0.1<(\beta_2/\beta_1)<$ approximately 0.8 when the overall length of the stepped bead formed on a short side of the frame is $\beta_1$ and the length of the lower step of the stepped bead formed on the short side is $\beta_2$.

6. The frame for a color CRT according to claim 1, wherein a ratio of $\gamma_2$ about $\gamma_1$ is characterized by range of approximately $0.2<(\gamma_2/\gamma_1)<$ approximately 0.8 when the overall height of the stepped bead formed on a long side of the frame is $\gamma_1$ and the height of the lower step of the stepped bead formed on the long side is $\gamma_2$.

7. The frame for a color CRT according to claim 1, wherein a ratio of $h_2$ about $h_1$ is characterized by range of approximately $0.2<(h_2/h_1)<$ approximately 0.65 when the overall width of the stepped bead formed on a short side of the frame is $h_1$ and the width of the lower step of the stepped bead formed on the short side is $h_2$.

8. A frame for a color CRT, comprising:

a frame having a square shape configured to support a shadow mask; and a plurality of stepped beads having at least two steps formed on corner portions of the frame in order to prevent distortion of the shadow mask, wherein a ratio of $\alpha_2$ about $\alpha_1$ is characterized by a range of approximately $0.1<\alpha_2/\alpha_1<$ approximately 0.8, when the overall length of the stepped bead formed on a long side of the frame is $\alpha_1$, and the length of a lower step of the stepped bead formed on the long side is $\alpha_2$.

9. A frame for a color CRT, comprising:

a frame having a square shape configured to support a shadow mask; and a plurality of stepped beads having at least two steps formed on corner portions of the frame in order to prevent distortion of the shadow mask, wherein a ratio of $\beta_2$ about $\beta_1$ is characterized by a range of approximately $0.1<(\beta_2/\beta_1)<$ approximately 0.8 when the overall length of the stepped bead formed on a short side of the frame is $\beta_1$ and the length of the lower step of the stepped bead formed on the short side is $\beta_2$.

10. A frame for a color CRT, comprising:

a frame having a square shape configured to support a shadow mask; and a plurality of stepped beads having at least two steps formed on corner portions of the frame in order to prevent distortion of the shadow mask, wherein a ratio of $\gamma_2$ about $\gamma_1$ is characterized by range of approximately $0.2<(\gamma_2/\gamma_1)<$ approximately 0.8 when the overall height of the stepped bead formed on a long side of the frame is $\gamma_1$ and the height of the lower step of the stepped bead formed on the long side is $\gamma_2$.

11. A frame for a color CRT, comprising:

a frame having a square shape configured to support a shadow mask; and a plurality of stepped beads having at least two steps formed on corner portions of the frame in order to prevent distortion of the shadow mask, wherein a ratio of $h_2$ about $h_1$ is characterized by range of approximately $0.2<(h_2/h_1)<$ approximately 0.65 when the overall width of the stepped bead formed on a short side of the frame is $h_1$ and the width of the lower step of the stepped bead formed on the short side is $h_2$.

* * * * *